United States Patent [19]

Pagan

[11] Patent Number: 4,585,368

[45] Date of Patent: Apr. 29, 1986

[54] SUCKER ROD ASSEMBLY

[76] Inventor: Augustine J. Pagan, 1117 Lorna Dr., El Cajon, Calif. 92020

[21] Appl. No.: 650,912

[22] Filed: Sep. 17, 1984

[51] Int. Cl.[4] ..... F16B 11/00

[52] U.S. Cl. ..... 403/266; 403/265; 403/268; 403/365; 403/343; 166/68

[58] Field of Search ..... 403/265, 266, 267, 268, 403/365, 343, 344; 156/289, 294; 166/68

[56] References Cited

U.S. PATENT DOCUMENTS

| | | | |
|---|---|---|---|
| 4,205,926 | 6/1980 | Carlson | 403/266 |
| 4,360,288 | 11/1982 | Ruttledge, Jr. et al. | 403/268 |
| 4,401,396 | 8/1983 | McKay | 403/268 X |
| 4,430,018 | 2/1984 | Fischer | 403/268 |
| 4,433,933 | 2/1984 | Parsons, Jr. et al. | 403/368 X |
| 4,475,839 | 10/1981 | Strandberg | 403/268 X |
| 4,494,890 | 6/1985 | Lusk | 403/374 X |
| 4,522,529 | 6/1985 | Conley | 403/265 X |

FOREIGN PATENT DOCUMENTS

| | | | |
|---|---|---|---|
| 694240 | 9/1930 | France | 403/365 |
| 681550 | 10/1952 | United Kingdom | 403/267 |
| 1051558 | 12/1966 | United Kingdom | 403/268 |

*Primary Examiner*—Thomas F. Callaghan
*Assistant Examiner*—Joseph A. Fischetti

[57] ABSTRACT

A sucker rod assembly useful in oil wells and the like is provided. In making the assembly, a longitudinally extending generally central cavity in a sucker rod end casing is coated with a mold release agent and the cavity interior surface includes longitudinally spaced inwardly directed annular wedges disposed transversely of the casing to provide a wave-like form. A plurality of separate rigid inserts are inserted longitudinally into the cavity and extend substantially the length of the plurality of wedges, collectively mating with the interior surface of the casing, and defining a central longitudinal space. An adhesive such as epoxy resin is poured into the central space and then a sucker rod end is inserted in that space. Thereafter the inserts are longitudinally biased relative to the casing to cause the wedges to force the inserts tightly against the outer surface of the sucker rod end until the adhesive sets in a strong thin bond layer to permanently secure the inserts to the sucker rod end and to bond the inserts together. The described fittings are secured at opposite ends of the sucker rod to firmly hold it without crushing it.

26 Claims, 11 Drawing Figures

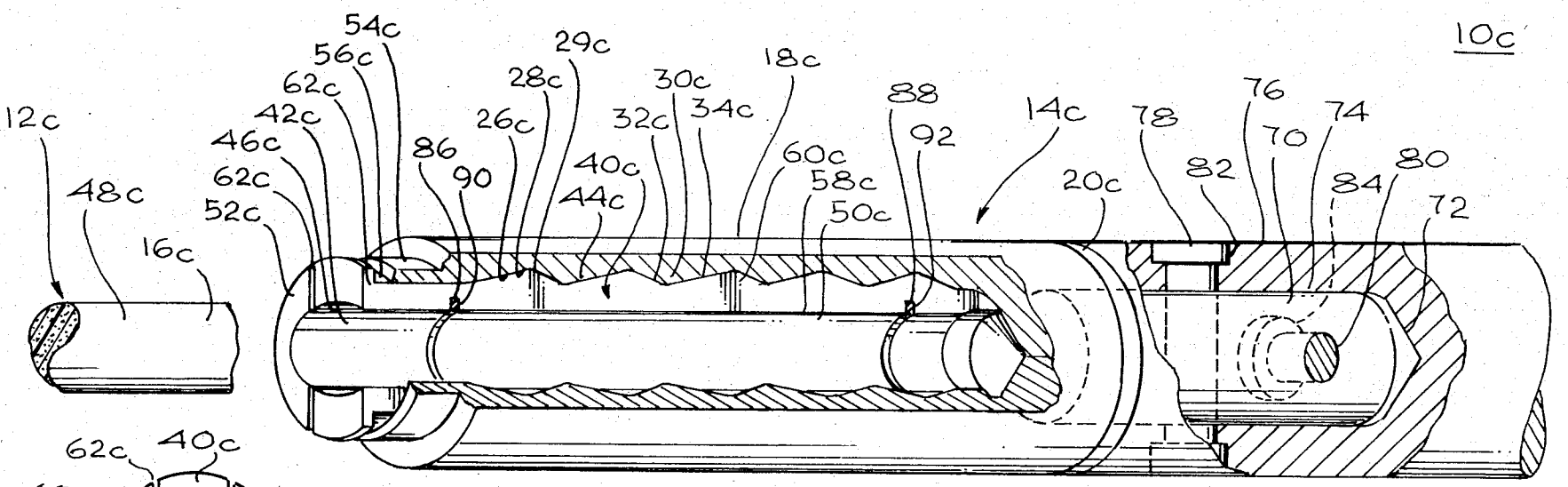
Fig. 5
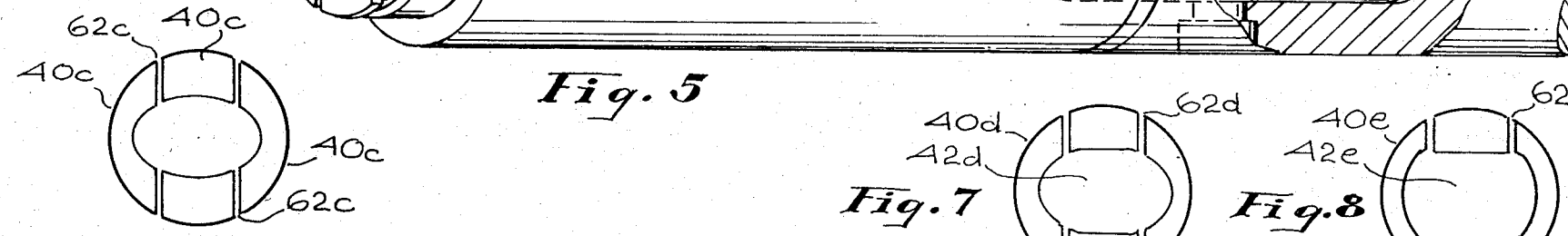
Fig. 8
Fig. 7
Fig. 6
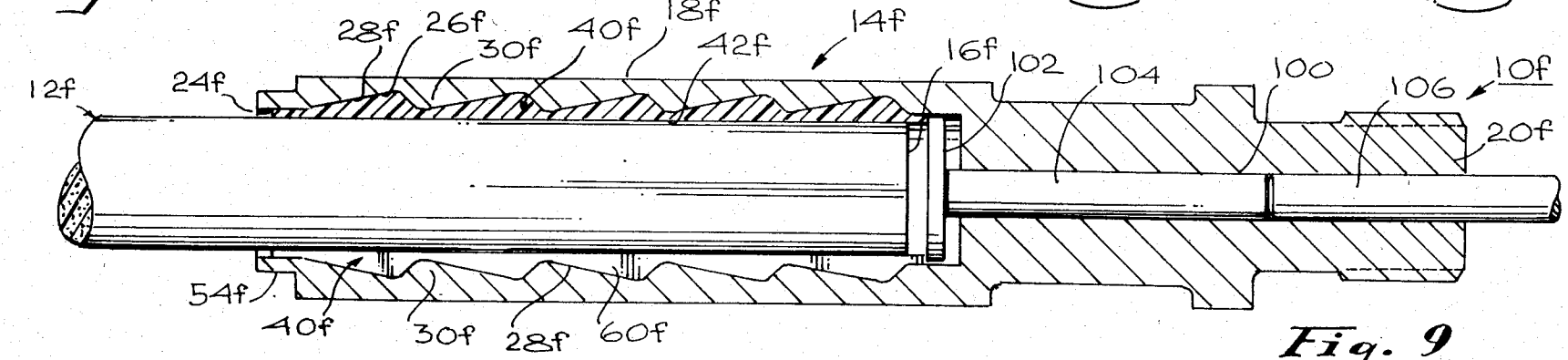
Fig. 9

SUCKER ROD ASSEMBLY

BACKGROUND OF THE INVENTION

1. Field of the Invention

The present invention generally relates to well equipment and more particularly to an improved sucker rod assembly and method of making the same.

2. Prior Art

Conventional sucker rods are usually fabricated of metal in lengths of about 25 to 40 feet. These lengths are interconnected to form sucker rod strings useful for well pumping purposes. Because metal sucker rod strings are relatively heavy, recently efforts have been made toward developing and using sucker rods which include non-metallic components. For example, U.S. Pat. No. 3,212,582 discloses the use of plastic sucker rods; so also does U.S. Pat. No. 3,889,579. U.S. Pat. Nos. 4,360,288, 4,401,396, 4,024,913 and 4,416,329 also disclose non-metallic sucker rods. Certain of such non-metallic sucker rods have been provided in continuous lengths. See for example U.S. Pat. Nos. 4,416,329 and 3,889,579.

Difficulties have been encountered with non-metallic sucker rods whether of the continuous type or of the multiple interconnected type. In this regard, non-metallic sucker rods such as those made of plastic, fiberglass or other non-metallic fibrous compositions are relatively difficult to grip with end fittings without having the end fittings slip off or crush the rod ends. Additionally, since the rods flex, some difficulties have been encountered with so-called pinch-off of the rods at about the point of exit of the rod from the end fitting.

Various patents have been addressed to the provision of improved designs of metallic fittings used on non-metallic sucker rod ends; for example U.S. Pat. Nos. 4,360,288 and 4,401,396. Certain end fittings for non-metallic sucker rods have been provided which include internal teeth formed by pouring molten potting material into configured end fitting cavities. The potting material is set to hardness and bonds to the sucker rod exterior. The set potting compound may or may not bond to the interior surface of the fitting. However, because the thickness of the potting material is variable and large, the bond of the potting material to the sucker rod exterior is relatively weak. Loosening of that bond can occur with subsequent slipping of the fitting and potting material from the rod, resulting in loss of the rod, interruption of well pumping activity, etc.

Accordingly, there is a need for an improved method of making a sucker rod assembly which employs a non-metallic sucker rod and rod end fittings. The end fittings should securely hold the rod ends without crushing or pinch-off for improved sucker rod longevity. The method should be simple, effective and inexpensive and the assembly should have improved performance characteristics.

SUMMARY OF THE INVENTION

The improved sucker rod assembly of the present invention and method of making the same satisfy all the foregoing needs. The assembly and method are substantially as set forth in the Abstract above. Thus, the assembly is made by coating the interior surface defining the longitudinally extending generally central cavity of a sucker rod end fitting casing with a mold release agent or the like and setting the agent in place. That casing interior is provided with a number of longitudinally spaced inwardly directed wedges along the length thereof. The wedges are disposed transversely of the casing and are annular and each wedge comprises a pair of sloped interconnected wall portions. The wedges collectively have a wave-like form along the length of the interior surface.

A plurality of separate rigid inserts, preferably three or more in number, are inserted into the cavity so that they extend substantially the length of the plurality of wedges, collectively mate with the interior of surface of the casing, and define a central space. A strong adhesive material in unset form is added to that central space, after which the sucker rod end is inserted into the space. The inserts are then biased longitudinally relative to the casing. Thus, the inserts may include forward flanged ends readily grippable by a tool to accomplish this biasing. For example, the inserts can be pulled forward relative to the casing, causing the wedges to force the inserts tightly against the exterior surface of the rod end, thereby thinning the adhesive disposed over that surface. Alternatively, a disc or pusher can be positioned in the casing cavity behind the inserts and can be forced forward against the inserts by a rod extending through the opposite closed end of the casing, to accomplish the biasing. This biasing is continued until the adhesive is permanently set to bond the inserts to the rod end and to each other but not to the casing. It has been determined that the thinner and more uniform the bond layer is, the stronger the bonding force exerted by the adhesive to hold the inserts to the rod end. Accordingly, the likelihood of slipping of the fitting from the rod end is reduced substantially so that an improved assembly is provided.

The inserts are preferably molded plastic and are relatively inexpensive to produce and to use. The plastic may be filled with non-metallic fibers or the like. The sucker rod may be non-metallic, such as plastic, fiberglass, carbon or graphite fiber or the like, bonded in plastic, etc. The wedges may or may not differ from each other in size, shape or angle and the fitting may include a collar of reduced diameter extending forward from the casing, which collar may have an externally tapered configuration for improved performance. The inserts may include one or more annular grooves disposed in the interior surface thereof defining the rod-receiving space into which grooves insert retainer rings can slip. Thus, in one embodiment of the present invention, after installation into the cavity, the inserts are held aligned therein by one or more retainer rings fitting into grooves, after which the adhesive and sucker rod are introduced as previously described.

The components of the improved assembly are simple, durable, effective and inexpensive, as are the method and its steps. Further features of the present invention are set forth in the following detailed description and accompanying drawings.

DRAWINGS

FIG. 5 is a schematic perspective view, partly broken away, of a fourth preferred embodiment of the improved sucker rod assembly of the present invention;

FIG. 6 is a schematic front elevation of the inserts used in the embodiment of FIG. 5;

FIG. 7 is a schematic front elevation of an alternate form of the inserts usable in the embodiment of FIG. 5; and, FIG. 8 is a schematic front elevation of a further form of the inserts embodiment of FIG. 5;

FIG. 9 is a schematic longitudinal cross-section of a fifth preferred embodiment of the improved sucker rod assembly of the present invention;

DETAILED DESCRIPTION

Figure 1:
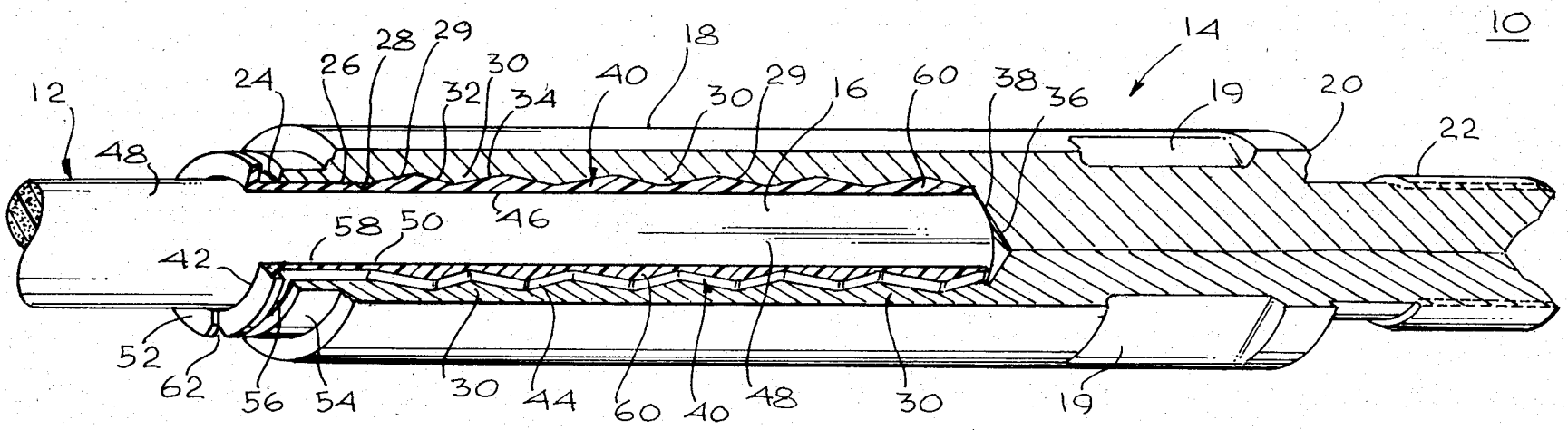
FIG. 1 is a schematic perspective view, partly broken away, illustrating a first preferred embodiment of the improved sucker rod assembly of the present invention.
Figure 2:
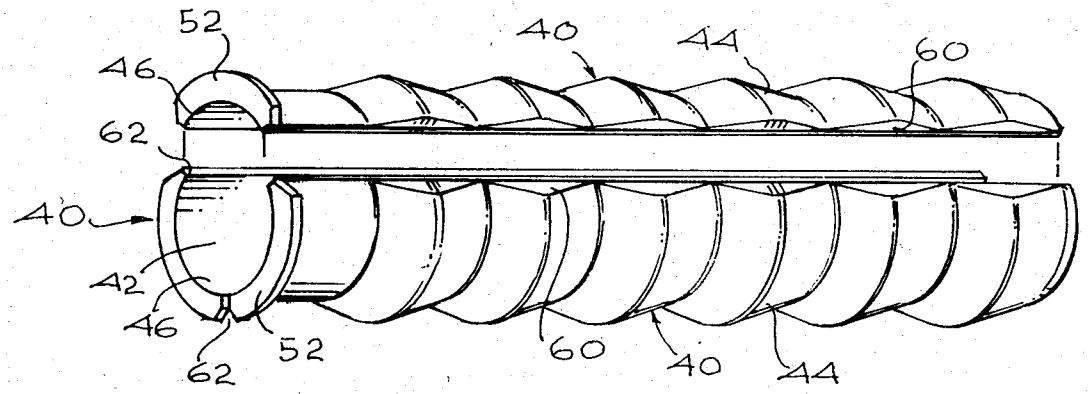
FIG. 2 is a schematic perspective view of the three inserts utilized in the assembly of FIG. 1.

FIGS. 1 and 2

Now referring more particularly to FIG. 1 of the accompanying drawings, a first preferred embodiment of the improved sucker rod assembly of the present invention is schematically depicted in perspective view. Thus, assembly 10 is shown which comprises a cylindrical sucker rod 12 of any suitable material, for example, metal, fiberglass, plastic, carbon or graphite fibers, boron fibers or any suitable combination thereof, together with a pair of end fittings 14, only one of which is shown in FIG. 1. Fittings 14 are disposed on the opposite ends 16 of sucker rod 12.

Each fitting 14 comprises an elongated tubular casing 18 of metal, such as stainless steel, tool steel, etc. or other suitable material having spaced flat portions 19 to facilitate the use of a wrench or other tool, and a closed end 20 bearing connector means such as a threaded end portion 22 which enables fittings 14 to be releasably secured to threaded female couplings (not shown) for interconnection with other similar sucker rod assemblies (not shown) in a sucker rod string (not shown). Thus, assembly 10 is intended for use as one of a number of such assemblies in a sucker rod string interconnected to, for example, a downhole well pump (not shown) and also to pump motive means (not shown) above the well. Sucker rod 12 may be, for example, 25–40 feet in length, although other lengths are also possible.

Casing 18 includes an open opposite end 24 communicating witn an internal cavity 26 which extends longitudinally through the center of casing 18, as shown in FIG. 1. Cavity 26 is defined by the inner surfaces 28 of casing 18. Surfaces 28 define a plurality of internally directed longitudinally spaced wedges 30 along the length thereof, each wedge 30 comprising a pair of sloped innerconnected wall portions 32 and 34. Wedges 30 collectively have a wave-like form, as shown in FIG. 1. Wedges 30 are annular and disposed transversely of the longitudinal axis of casing 18. Inner surfaces 28 may terminate at a closed inner end 36 in a cone-shaped configuration and the tip 38 of rod 12 may be similarly shaped so that it seats into end 36 to properly center it in cavity 26. However, other alignment means can be used.

In carrying out the method of the present invention, inner surfaces 28 are first coated with a liquid mold release agent or the like, for example, dimethyl polysiloxane or other silicone in a solvent and the mold release agent is then set in place to solid state to form a release layer 29. Thereafter, a plurality of separate rigid inserts 40, such as are more particularly illustrated in FIG. 2, are placed into cavity 26. Each insert 40 extends substantially the length of the plurality of wedges 30, and inserts 40 collectively mate with the sides of inner surfaces 28, as shown particularly in FIG. 1. They also collectively define a central longitudinally extending cylindrical space 42.

In the embodiment illustrated in FIGS. 1 and 2, there are three inserts 40, each being curved and and accounting for about one-third of the collective outer surface 44 thereof which matches wedges 30. The three inserts 40 also provide collectively a cylindrical inner surface 46 conforming to the cylindrical outer surface 48 of rod end 16. Inserts 40 can be fabricated of any suitable material, including metal. However, they are most preferably fabricated by molding a high temperature thermoplastic or thermosetting material, for example a thermoplastic such as polysulfone, polyethersulfone, polyetherimide or polyphenylene sulfide. Preferably, the plastic material is filled with fiberglass or graphite or carbon fibers. A suitable thermosetting plastic could be used, such as phenolic resin or the like. Epoxies, polyesters and other thermosetting plastics can also be used. Preferably, the plastic in molten form is injected into a mold and set to the desired shape, shown in FIG. 2. Moreover, each insert 40 preferably projects beyond the front open end 24 of casing 18 and terminates in a peripheral annular flange 52, which can be broken off, if desired, from the finished assembly 10. It will be further noted that the front end 24 of casing 18 preferably is provided with a narrow collar 54 which terminates short of flange 52 to provide a space 56 therebetween in which a biasing tool (not shown) can be inserted and used as described below.

Further in accordance with the present method, an adhesive so, such as high temperature resistant epoxy resin thermosetting adhesive or the like, is poured into space 42 in a controlled amount so that it will form when spread over surface 48 and set a thin bonded layer 58 approximately, for example, 0.005–0.015 inch in thickness. Other bonding thicknesses can be used. However, it has been found that a thin uniform bonding layer 58 such as described above is far stronger and it much more tenaciously bonds inserts 40 to rod end 16 than does a thick bonding layer such as occurs when inserts are formed in situ of potting compound or the like in an end fitting and simultaneously bond to a sucker rod end during such formation.

As rod end 16 passes into space 42, adhesive 50 is caused to flow up between surface 58 and surface 46 uniformly to coat surface 48 to a predetermined thickness, any excess passing out of front end 24. This uniform spreading is facilitated when, in accordance with the present method, inserts 40 are then biased longitudinally relative to casing 18 so as to force inserts 40 tightly against surface 48 and squeeze adhesive 50 into the lines 62 of abutment between inserts 40. This longitudinal bias is effected by pulling inserts 40 from the front end 24 of casing 18. In order to accomplish this, the jaws of a tool (not shown) can be inserted in the annular groove 56 between the front end collar 54 and flange 52 to clamp inserts 40 tightly together as they are simultaneously pulled towards end 24.

It will be noted that the outer surface 44 of inserts 40 defines wedges 60 filling the intervals between wedges 30. As inserts 40 are pulled from end 24, wedges 30 uniformly bias inserts 40 towards outer surface 48 of rod end 16, causing adhesive layer 58 to uniformly thin to a predetermined degree. This biasing force is maintained until bond layer 58 is set. The setting action can be controlled by the use of catalyst and/or temperature, depending on the adhesive used. The previously described very thin and uniform bond layer 58 is thus obtained to hold inserts 40 tenaciously against outer surface 48 of rod end 16 to prevent rod end 16 for separating from fitting 14.

It will be understood that the described biasing can be achieved because inserts 40 are not bonded to casing 18, such as occurs when a potting material is poured into a casing cavity containing a sucker rod end so that the potting compound locks to the casing and to the sucker rod end. Under such circumstances it is very difficult to obtain a thin, uniform bond layer. Instead, relatively thick, variable thickness bonds are obtained which are substantially inferior in strength to the bond provided by layer 58.

Upon setting of layer 58, assembly 10 is complete. It will be understood that the same procedure occurs at both ends 16 of rod 12 utilizing identical end fittings 14. Assembly 10 exhibits improved strength and is faster and less expensive to produce than conventional sucker rod assemblies. In the embodiment of FIG. 1, wedges 30 are of substantially uniform configuration, size and spacing. FIG. 2 illustrates the mating configuration of inserts 40 with substantially uniform wedges 60.

EXAMPLE

An improved sucker rod assembly 10, as depicted in FIG. 1, is made using a sucker rod 12 approximately 37 feet in length, cylindrical and with a diameter of 1 inch and comprising fiberglass in a matrix of set thermoplastic. The sucker rod 12 is connected to an end fitting 14 on each of the two opposite ends 16 thereof to form assembly 10. Each end fitting 14 has an alloy steel tubular casing 18 with a length of 9 inches and a diameter of $1\frac{5}{8}$ inch. The closed end 20 thereof has a plurality of threads 22 for connection to a female coupling while the open end 24 thereof communicates with an internal cavity 26 having a length of about 5 inches, an O.D. of about 1.40 inch and an I.D. of about 1.09 inch.

In accordance with the present method, casing 18 is first cleaned and flushed with a suitable solvent, then dried. It is then filled with a resinous liquid mold release agent such as dimethylpolysiloxane or another silicone resin in a solvent. Thus, the release agent is first spread over the inner surface 28 of casing 18, including wedges 30, each of which has a height of $\frac{1}{8}$ inch. Wedges 30 collectively extend over a length of 4.50 inches in cavity 26. The mold release agent is then poured out of casing 18 and casing 18 is baked at, for example, 250° F. for 30 minutes to set and cure the layer of release agent in cavity 26. Other times and temperatures can be used, depending on the nature of the release agent.

After the release agent is set in place, three inserts 40, each approximately 5 inches in length and having an average O.D. and I.D. of 1.3 inch and 1.09 inch are inserted into cavity 26. Inserts 40 mate with the sides of surfaces 28 and each other, and bear wedges 60 which fill the intervals between wedges 30. Inserts 40 each comprise a molded high temperature thermoplastic material, such as set cured phenolic resin filled with approximately 30% by weight of glass fibers. Alternatively, the inserts can be of epoxy resin, polyester resin, etc.

After inserts 40 are installed in cavity 26, a paste epoxy resin adhesive 50 containing a conventional catalyst in the form of an amine is placed in the central cylindrical space 42 collectively defined by the curved inner surfaces 46 of inserts 50. The amount of epoxy resin adhesive 50 used is approximately 20 grams. Another curable liquid resin such as a phenolic resin, etc. could be used instead of the epoxy resin. Thereafter, the end 16 of rod 12 is inserted in space 42 and seated fully therein, causing adhesive 50 to spread uniformly over the outer surface 48 thereof. A clamping tool is then placed in groove 56 between collar 54 and flange 52 of fitting 14, casing 18 is separately gripped to prevent it from moving and the assembly is heated to 250° F. to liquify the adhesive, allowing resettling of inserts 40 and causing the resin to gel. A longitudinal biasing force of approximately 40 pounds is then applied to inserts 40 to move them longitudinally away from the front of casing 18. This in turn causes wedges 30 to drive inserts 40 uniformly firmly towards surface 48 to thin adhesive 50 out to a bond layer 58 of approximately 0.015–0.005 inch in thickness when set. The setting occurs within one minute at the previously indicated temperature. A one hour curing period at elevated temperature completes the bonding procedure. Other adhesives may require different setting and curing times and temperatures to accomplish the same results. Thereafter, the biasing force and clamp are removed and casing 18 is found to be securely locked to rod 12 for an improved assembly 10.

A plurality of assemblies 10, when interconnected through end fittings 14 and associated female couplings, form collectively an improved lightweight sucker rod string readily connectible to a well pump and motive means. The string is found under test conditions to have improved durability, not being subject to pinch-off or rod end crushing or slippage. Comparable results are obtained when other plastic adhesives are used in place of adhesive 50, thermosetting resins are used in inserts 40 and rods 12 are of carbon and/or graphite fiber instead of fiberglass.

FIG. 3

Figure 3:
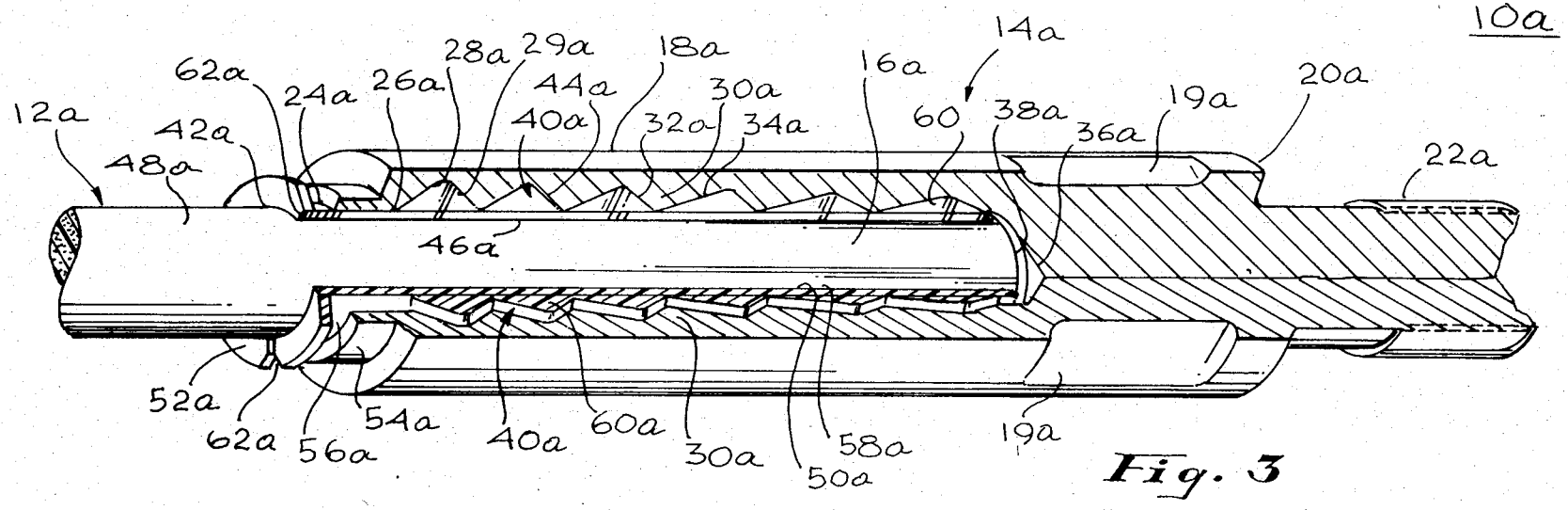
FIG. 3 is a schematic perspective view, partly broken away, of a second preferred embodiment of the improved sucker rod assembly of the present invention.

Now referring more particularly to FIG. 3 of the accompanying drawings, a second preferred embodiment of the improved assembly of the present invention is schematically depicted therein. Thus, assembly **10*a* is shown. Components thereof similar to those of assembly 10 bear the same numerals but are succeeded by the letter "a". Thus, assembly 10*a* is substantially identical to assembly 10 except for the fact that wedges 30*a* differ from one another in length and angle, varying from about 10° to about 21° in angle from the longitudinal axis of rod 16*a*. In contrast, wedges 30 of FIG. 1**, are essentially uniform in angle.

In assembly **10*a*, wedges 30*a* closest to open end 24*a* of casing 18*a* exhibit the largest angle from the longitudinal axis of rod 16*a* and fitting 14*a* and are the shortest in length. Casing 18*a* is otherwise identical to casing 18, including wrench flats 19*a*, closed end 20*a* with threaded portion 22*a*, and collar 54*a*. Inserts 40*a* may be, for example, three in number and identical to inserts 40 except for the different angles of inclination of wedges 60*a* from each other and from wedges 60. Tool space 56a is provided between collar 54a and flange 52. As in assembly 10, inserts 40a are disposed in cavity 26a and rod end 16a is disposed in space 42a. A thin, uniform bond layer 58a comprising set adhesive 50a, such as epoxy resin adhesive, or the like, tenaciously bonds inserts 40a to each other at their lines of abutment 62a and also to surface 48a of rod end 16a. Release layer 29a allows inserts 40a and bonded end 16a to be moved relative to casing 18a before and during the biasing operation. Thus, assembly 10a is made in accordance with the method of the present invention as previously described for assembly 10. Assembly 10a has substantially the advantages of assembly 10, except that since wedges 60a differ from one another in angle, centering of rod 12a does not automatically occur as inserts 40a are forced against rod 12a** during the bonding procedures.

FIG. 4

Figure 4:
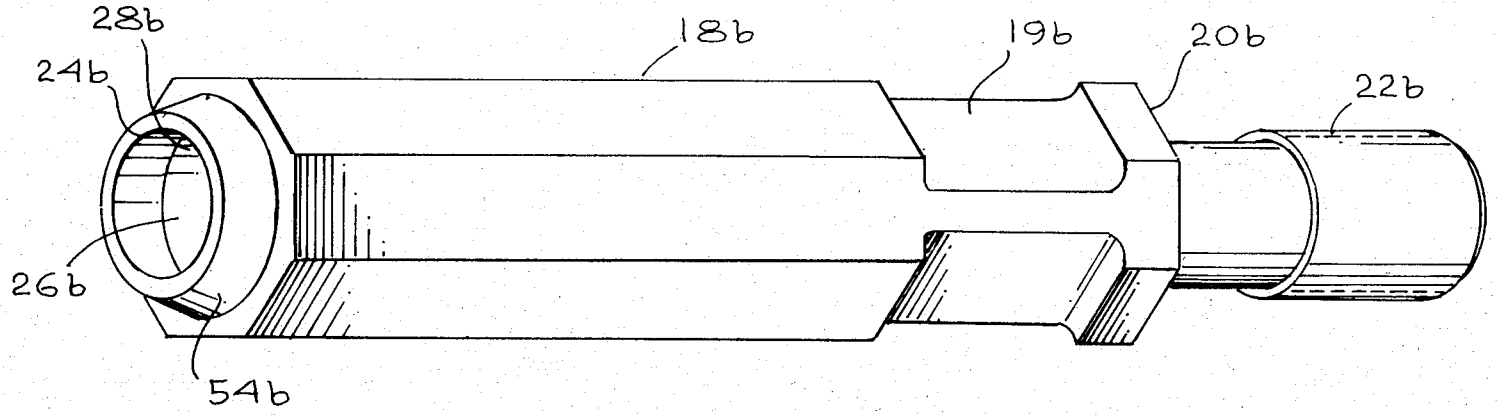
FIG. 4 is a schematic perspective view of a third preferred embodiment of the casing used in the assembly of the present invention.

Now referring more particularly to FIG. 4 of the accompanying drawings, a modified version of the casing which is suitable for use in the assembly of the present invention is schematically depicted therein. Thus, casing 18b is shown in schematic perspective view. Casing 18b is substantially identical to casing 18 except that its outer surface is octagonal but includes wrench flats 19b, closed end 20b and threaded connector portion 22b, as well as an opposite end 24b. End 24b is provided with a collar 54b which has a forwardly tapered outer surface, as shown in FIG. 4. Casing 18b can be substituted for casing 18 in assembly 10 and has substantially the same advantages.

FIGS. 5–6

FIG. 5 is a schematic perspective view of a fourth preferred embodiment of the improved sucker rod assembly of the present invention. Thus, assembly 10c is shown. Components thereof which are similar to those of assembly 10 bear the same numerals but are succeeded by the letter "c". Assembly 10c differs from assembly 10 only in a few respects. In this regard, sucker rod end 16c is oval in transverse cross-section, as shown in FIG. 6. Accordingly, inserts 40c collectively define space 42c which is also oval and closely conforms to outer surface 48c of rod end 16c. Inserts 40c are disposed in casing 18c, the inner surfaces 28c of which define cavity 26c and wedges 30c. Closed end 20c includes an elongated rod 70 having a cone-shaped nose 72 seated in a cavity 74 in a female coupling 76, as shown in FIG. 5. Casing 18c is releasably secured to coupling 76 by removable pins 78 and 80 disposed at right angles to each other in aligned passageways 82 and 84, respectively, extending through rod 70 and coupling 76. Fitting 14c is intended for use preferably with a single continuous sucker rod 12c, one such fitting 14c being connected to each of the two opposite ends 16c of rod 12c. Inserts 40c are four in number, are initially aligned with each other by the use of spaced internal retainer rings 86 and 88 which seat flush in grooves 90 and 92, respectively, in inner surfaces 46c of inserts 40c before being permanently connected to each other along lines 62c by the same adhesive 50c which forms bonding layer 58c to hold inserts 40c firmly against outer surface 48c. Assembly 10c is prepared in accordance with the method of the present invention, as described above in connection with assembly 10. Assembly 10c has substantially the advantages and properties of assembly 10.

FIGS. 7–8

FIG. 7 is a schematic end view of inserts 40d, four in number and substantially identical to inserts 40c except that inserts 40d are shaped to define space 42d which is an oval in transverse cross-section but flattened at the top and bottom, as shown in FIG. 7, to conform to the shape of a rod end (not shown) comparable to rod end 16c.

FIG. 8 depicts four inserts 40e substantially identical to inserts 40c except that space 42e defined thereby has a slightly different transverse cross-sectional configuration than space 42c and is intended to fit a sucker rod end (not shown) having such a cross-sectional configuration.

FIG. 9

FIG. 9 is a schematic longitudinal cross-section of a fifth preferred embodiment of the improved sucker rod assemblies 10, 10a, present invention. Thus, assembly 10f is shown. Components thereof which are similar to those of any of assembly 10, 10a, 10b or 10c bear the same numerals but are succeeded by the letter "f". Assembly 10f differs from assembly 10 only in a few respects. Thus, the tip of sucker rod end 16f is flat. Inserts 40f collectively define space 14f which is circular in transverse cross-section as is rod 12f. Inserts 40f are disposed in casing 18f, the inner surfaces 28f which define cavity 26f and wedges 30f. Open end 24f has a narrow collar 54f of uniform diameter. It will be noted that inserts 40f have no front flange comparable to flange 52. Instead, closed end 20f of casing 18f has a central longitudinal passageway 100 which extends all the way into cavity 26f. A disc 102 is positioned directly behind inserts 40f and is of sufficient diameter to abut them as shown in FIG. 9. One or more rods 104 and 106 are disposed in passageway 100 so that rod 104 can be made to bear against disc 102.

During the assembly of 10f the procedure as specified for assembly 10 is followed except that disc 102 is placed in cavity 26f before inserts 40f and rod end 16f. A mold release agent is applied to wedges 30f and dried in place, after which inserts 40f are disposed in cavity 26f, an adhesive is poured into space 42f, whereupon end 16f is inserted in that space, heat is applied to casing 18f and during setting of the adhesive, the biasing force is applied by rod 104 or rods 104 and 106 forcing disc 102 forward, driving with it inserts 40f so that wedges 30f force them tightly against rod 12f. This biasing force is continued until the adhesive is set to securely bond inserts 40f to rod 12f, locking rod 12f in casing 18f. Rods 104 and 106 can thereafter be removed from passageway 100 but disc 102 is permanently in place in cavity 26f. This procedure has been found to be advantageous for firmly bonding the components of assembly 10f together.

Disc 102 and rods 104 and 106 can be fabricated of any suitable material, such as metal, or impact-resistant plastic, etc.

FIG. 10

Figure 10:
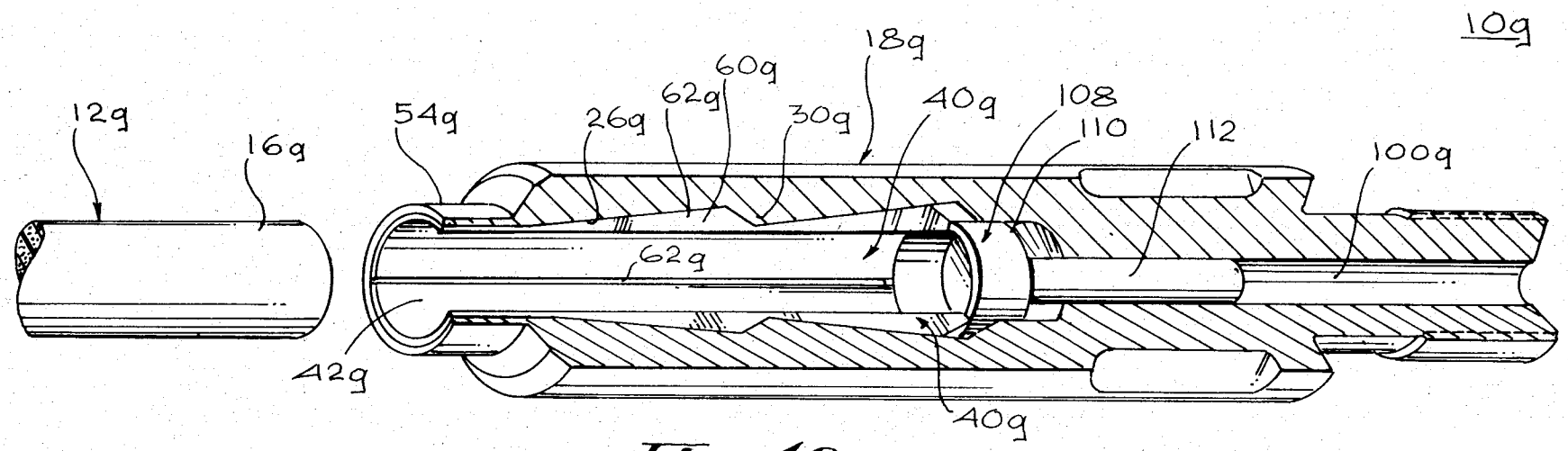
FIG. 10 is a schematic perspective view, partly broken away, of a sixth preferred embodiment of the improved sucker rod assembly of the present invention; and, FIG. 11 is a schematic perspective view, partly broken away, of a seventh preferred embodiment of the improved sucker rod assembly of the present invention.

FIG. 10 is a sixth preferred embodiment of the improved assembly of the invention and is schematically shown in perspective view in FIG. 10. Thus, new assembly 10g is shown. Components thereof similar to those of any of assemblies 10, 10a, 10b, 10c or 10f bear the same numerals but are succeeded by the letter "g". Assembly 10g is very similar to assembly 10f but differs only in having a pair of wedges 30g instead of five wedges 30f as shown in FIG. 9 for assembly 10f. Assembly 10g is fitted with a pusher 108 similar to disc 102 plus rod 104. However, pusher 108 includes a ring 110 which abuts the rear end of inserts 40g, which ring 110 is connected to rod 112 extending through passageway 100g in the same manner as rod 104. Assembly 10g is assembled in the same manner as assembly 10f in that pusher 108 is inserted into cavity 26g and passageway 100g before inserts 40g and rod 12g are inserted therein. The biasing force previously described as being applied by disc 102 through rod 104 is applied by pusher 108, when rod 112 thereof is urged forward by another rod (not shown) temporarily inserted behind it in passageway 100g. Assembly 10g is equivalent to assembly 10f in components, their method of assembly and their general characteristics. Pusher 108 and its components can be fabricated from metal, impact resistant plastic and the like. Ring 110 thereof can be dimensioned to receive end 16g of rod 12g.

FIG. 11

Figure 11:
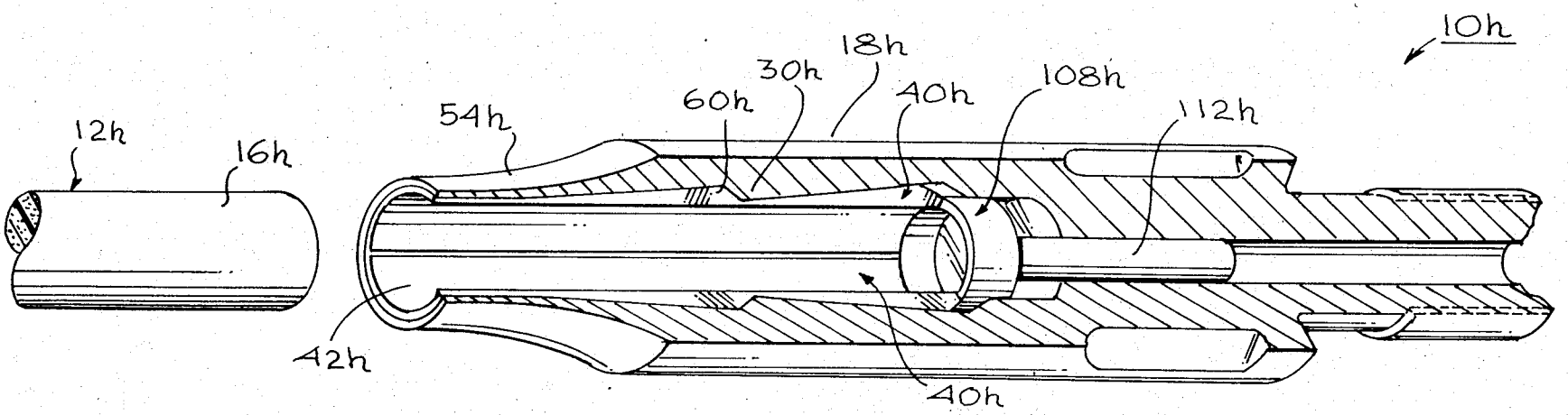

A seventh preferred embodiment of the improved sucker rod assembly of the present invention is schematically depicted in perspective view in FIG. 11. Thus, assembly 10h is shown. Components thereof which are similar to those of any of assemblies 10, 10a, 10b, 10c, 10f or 10g bear the same numerals but are succeeded by the letter "h". Assembly 10h differs from assembly 10g only in the single respect that collar 54h gradually narrows in diameter and thickness to its front end, in contrast with collar 54g of assembly 10g which is of uniform diameter. Collar 54h exhibits slightly improved overall strength in contrast with collar 54g. It will be noted that assembly 10h has only two wedges 30h and utilizes pusher 108h identical to pusher 108. Assembly 10h otherwise has the advantages and improved results of assembly 10g.

It will be understood that the inserts used in the present invention can be fabricated with any suitable configuration which accomplishes the intended purposes so as to closely conform to the outer surface of the sucker rod end and the inner multi-wedged surface of the casing sidewall. Various other modifications, changes, alterations and additions can be made in the improved assembly of the present invention, in the components and parameters thereof and in the present method and its steps and parameters. All such modifications, changes, alterations and additions, as are within the scope of the appended claims form part of the present invention.

What is claimed is:

1. An improved sucker rod assembly, said assembly comprising, in combination:

a. a sucker rod; and b. a pair of fittings secured to opposite ends of said rod, each said fitting including i. a rigid casing having interior end and side surfaces defining a cavity therein in which an end of said sucker rod is disposed, said interior side surface having a plurality of internally directed wedges disposed along the length thereof, each said wedge comprising a pair of sloped interconnected wall portions, said wedges collectively having a wave-like form along the length of said interior surface; and, ii. a plurality of separate rigid inserts, each said insert extending substantially the length of said plurality of wedges and along a portion of the periphery thereof and disposed between said wedges and said rod end in said cavity, the exterior surfaces of said plurality of inserts collectively conforming to the wave-like flange-defining interior side surface of said casing, said inserts being tightly bonded to the exterior of said rod end by a thin uniform layer of set adhesive to hold said rod end centered securely within said fitting cavity, said inserts being unbonded to the casing interior surfaces.

2. The improved assembly of claim 1, wherein said cavity extends longitudinally of said casing at about the longitudinal centerline thereof and wherein each said wedge is generally annular and transverse of said casing.

3. The improved assembly of claim 2, wherein said sucker rod is substantially non-metallic.

4. The improved assembly of claim 3, wherein said sucker rod comprises fiberglass.

5. The improved assembly of claim 3, wherein said sucker rod comprises fibers selected from the group consisting of graphite and carbon fibers and mixtures thereof.

6. The improved assembly of claim 3, wherein said sucker rod comprises plastic.

7. The improved assembly of claim 2, wherein said casing comprises metal.

8. The improved assembly of claim 2, wherein said casing has an open end receiving said rod in said cavity and an opposite closed connector end, and wherein said insert interior surfaces define an annular groove within which an insert retainer ring is disposed.

9. The improved assembly of claim 8, wherein said sucker rod is a continuous sucker rod and said fitting has a male end releasably secured in a female housing.

10. The improved assembly of claim 9, wherein said assembly includes release pins releasably secured through said female housing and said male end.

11. The improved assembly of claim 8, wherein said closed end of said fitting is threaded for connection to a threaded female coupling.

12. The improved assembly of claim 2, wherein there are at least three of said inserts, each of said inserts being bonded to the others of said inserts at the junctions therebetween to form a unitary structure.

13. The improved assembly of claim 12, wherein said sucker rod is oval in transverse cross-section and wherein the interior surfaces of said inserts collectively substantially duplicate the size and configuration of the exterior surface of said sucker rod end.

14. The improved assembly of claim 12, wherein the front ends of said inserts extend forwardly of said open end of said fitting and include means for gripping and pulling said inserts longitudinally relative to said casing while said sucker rod is in place therein so as to force said inserts tightly against the outer surface of said sucker rod end.

15. The improved assembly of claim 14, wherein said insert gripping means includes a flange on said front ends of said inserts spaced forwardly of said open end of said fitting.

16. The improved assembly of claim 12, wherein said inserts comprise molded plastic.

17. The improved assembly of claim 16, wherein said inserts include fibrous filler.

18. The improved assembly of claim 17, wherein said fibrous filler comprises non-metallic fibers.

19. The improved assembly of claim 1, wherein said wedges are substantially uniform in size, shape and angle.

20. The improved assembly of claim 1, wherein said wedges differ from each other in at least one of size, shape and angle.

21. The improved assembly of claim 1, wherein said open end of said fitting includes a collar having an internal diameter reduced in size relative to the internal diameter of the remainder of said cavity, said collar extending forwardly from said open end.

22. The improved assembly of claim 21, wherein said collar has an externally tapered configuration.

23. The improved assembly of claim 12 wherein said casing has an open end receiving said rod in said cavity and an opposite generally closed connector end defining a longitudinal passageway extending to said cavity, wherein a pusher is disposed in said cavity behind said inserts and biasable forward against said inserts to effect said tight bonding during connection of said rod to said fitting.

24. The improved assembly of claim 23 wherein said pusher comprises a disc.

25. The improved assembly of claim 23 wherein said pusher comprises a ring or disc connected to a rod disposed in said passageway.

26. The improved assembly of claim 1 wherein there are 2–6 of wedges in said casing.

* * * * *